United States Patent [19]

Tsubouchi et al.

[11] Patent Number: 4,704,490

[45] Date of Patent: Nov. 3, 1987

[54] FLUID FOR TRACTION DRIVE

[75] Inventors: Toshiyuki Tsubouchi; Hitoshi Hata, both of Sodegaura, Japan

[73] Assignee: Idemitsu Kosan Company, Limited, Tokyo, Japan

[21] Appl. No.: 594

[22] Filed: Jan. 6, 1987

[30] Foreign Application Priority Data

Jan. 23, 1986 [JP] Japan ..... 61-11170

[51] Int. Cl.[4] ..... C07C 15/18; C10M 105/04

[52] U.S. Cl. ..... 585/1; 585/20

[58] Field of Search ..... 585/1, 20

[56] References Cited

U.S. PATENT DOCUMENTS 4,329,529 5/1982 Nambu ..... 585/20
4,387,256 6/1983 Henderson et al. ..... 585/1
4,533,778 8/1985 Henderson et al. .

FOREIGN PATENT DOCUMENTS 0135871 4/1985 European Pat. Off. ..... 585/20
55-60596 5/1980 Japan .
60-86197 5/1985 Japan .

*Primary Examiner*—Curtis R. Davis
*Attorney, Agent, or Firm*—Walter H. Schneider

[57] ABSTRACT

The fluid for traction drive containing:

(A) an alkane derivative having at least three cyclohexane rings in a molecule; and (B) an alkane derivative having a main chain of two or three carbon atoms, to which at least two methyl groups are bonded, and having two cyclohexane rings in a molecule each bonded to one of the terminal carbon atoms of the alkane, or a cyclopentane derivative having two cyclohexane rings in a molecule, and which has a kinematic viscosity of at least 3 centistokes at 100° C.

The fluid has a high traction coefficient with stability over a wide range of temperature.

8 Claims, 12 Drawing Figures

FLUID FOR TRACTION DRIVE

BACKGROUND OF THE INVENTION

The present invention relates to a fluid for traction drive and more particularly to a fluid for traction drive which contains specified two kinds of compounds as main components and is excellent in traction performance.

A fluid for traction drive is a fluid for use in traction drive devices (devices driven by friction due to rolling contact), such as continuously variable transmissions for automobiles and industrial machines, hydraulic machines and the like. These fluids for traction drive are required to have a high traction coefficient and high stability against heat and oxidation, and further to be inexpensive.

In recent years, extensive investigations on a reduction in the size and weight of traction drive devices have been made particularly in the car industry. Under such circumstances, it is now required for such fluids for traction drive to be used in traction drive devices to be able to withstand use under severe conditions; in particular, to exhibit high performance with stability over a wide temperature range from low temperatures to high temperatures (from about −30° to 120° C.), including a high traction coefficient, relatively low viscosity, high oxidation stability and so on.

However a fluid satisfying the above requirements has not been developed; that is, conventional fluids have various problems. For example, compounds having a high traction coefficient at high temperatures produce a large stirring loss because of their high viscosity and therefore have problems in that the transmission efficiency is low and starting properties at low temperature are not good. On the other hand, compounds having a low viscosity and excellent transmission efficiency are low in the traction coefficient at high temperatures and further have a problem in that as the temperature rises, the viscosity excessively drops, thereby causing troubles in lublication of traction transmission devices.

SUMMARY OF THE INVENTION

The present invention is intended to overcome the problems of the prior art and an object of the present invention is to provide a fluid for traction drive which is capable of exhibiting excellent characteristics over a wide temperature range.

It has been found that the above object can be attained by using a specified compound group having a high traction coefficient at high temperatures in combination with a specified compound group having a low viscosity. That is, if the above two kinds of compounds are used in combination, there can be obtained a fluid for traction drive which is excellent in characteristics as described above and which has a greatly increased traction coefficient by the synergistic effect resulting from the use of the above two kinds of compounds in combination.

The present invention relates to a fluid for traction drive containing:

(A) an alkane derivative having at least three cyclohexane rings in a molecule; and (B) an alkane derivative having a main chain of two or three carbon atoms, to which at least two methyl groups are bonded, and having two cyclohexane rings in a molecule each bonded to one of the terminal carbon atoms of the alkane, or a cyclopentane derivative having two cyclohexane rings in a molecule, and which has a kinematic viscosity of at least 3 centistokes at 100° C.

DETAILED DESCRIPTION OF THE INVENTION

Figure 2:
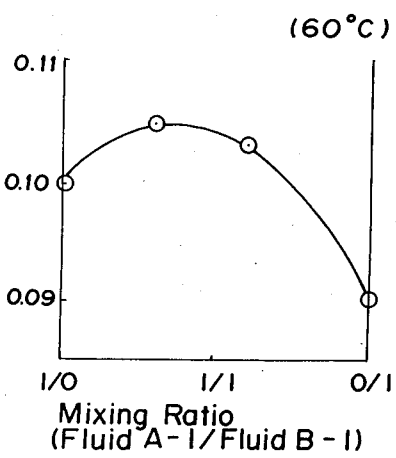
FIGS. 2, 4, 6, 8, 10 and 12 are graphs showing changes in traction coefficient when two of fluids prepared in Preparation Example are mixed and its mixing ratio is changed.

The fluid for traction drive of the present invention contains Components (A) and (B) as described above as main components.

As Component (A), various compounds can be used. Usually, however, compounds selected from the following three types of Compounds are preferably used. Compounds represented by the general formula (I)

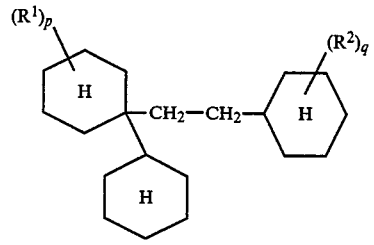

(I)

(wherein $R^1$ and $R^2$ each represent hydrogen or a methyl group, and p and q each represent 1, 2 or 3). These compounds are hereinafter referred to as "Type A1 Compounds". Compounds represented by the general formula (II):

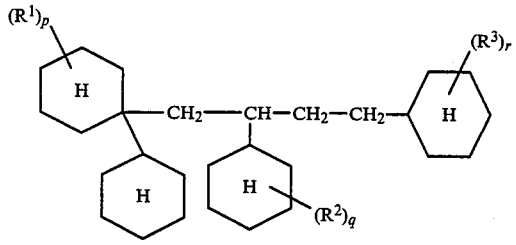

(II)

(wherein $R^1$, $R^2$, p and q are the same as defined above, $R^3$ represents hydrogen or a methyl group, and r represents 1, 2 or 3). These compounds are hereinafter referred to as "Type A2 Compounds". Compounds represented by the general formula (III):

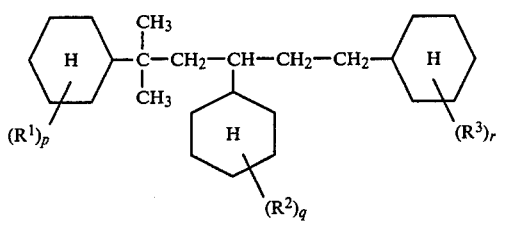

(III)

(wherein $R^1$, $R^2$, $R^3$, p, q, and r are the same as defined above). These compounds are hereinafter referred to as "Type A3 Compounds".

Representative examples of Type A1 Compounds represented by the general formula (I) are shown below. 1-Cyclohexyl-1-(2-cyclohexylethyl)cyclohexane having the formula:

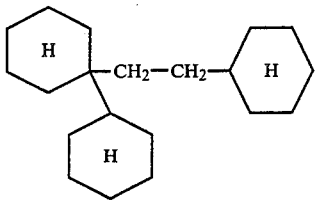

1-Cyclohexyl-1-(2-cyclohexylethyl)methylcyclohexane having the formula:

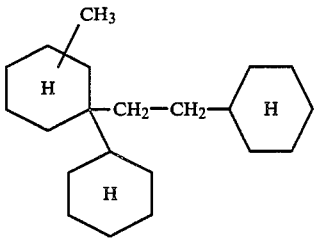

Representative examples of Type A2 Compounds represented by the general formula (II) are shown below. 1-Cyclohexyl-1-(2,4-dicyclohexylbutyl)cyclohexane having the formula:

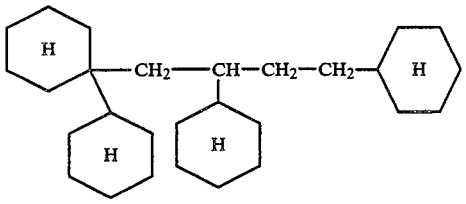

1-Cyclohexyl-1-(2,4-dicyclohexylbutyl)methylcyclohexane having the formula:

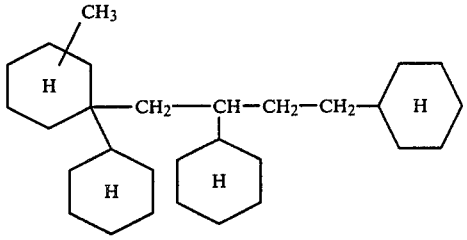

Representative examples of Type A3 Compounds represented by the general formula (III) are shown below. 1,3,5-Tricyclohexyl-5-methylhexane having the formula:

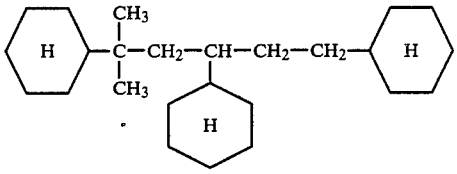

1,3-Di(methylcyclohexyl)-5-cyclohexyl-5-methylhexane having the following formula:

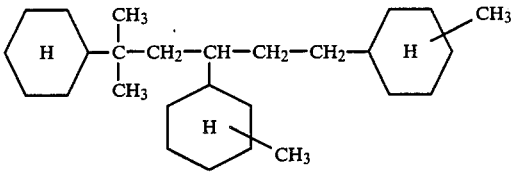

These compounds can be used alone or in combination with each other as Component (A).

As Component (B) to be used in combination with Component (A), two types of compounds are used; one of the type is an alkane derivative having a main chain of two or three carbon atoms, to which at least two methyl groups are bonded, and having two cyclohexane rings in a molecule each bonded to one of the terminal carbon atoms of the alkane, and the other is a cyclopentane derivative having two cyclohexane rings in a molecule.

Alkane derivatives belonging to the former type are hereinafter called "Type B1 Compounds", and compounds belonging to the latter type are hereinafter called "Type B2 Compounds". All of these Type B1 and B2 Compounds have two cyclohexane rings in which one or more methyl groups may be introduced.

Various compounds can be used as Type B1 Compounds. Usually, alkane derivatives represented by the general formula (IV):

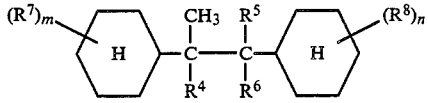

(IV)

(wherein $R^4$ to $R^8$ each represent hydrogen or a methyl group, provided that at least one of $R^4$ to $R^6$ is a methyl group, and m and n each represent 1, 2 or 3), and alkane derivatives represented by the general formula (V):

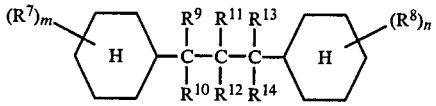

(V)

(wherein $R^7$, $R^8$, m and n are the same as defined above, and $R^9$ to $R^{14}$ each represent hydrogen or a methyl group, provided that at least two of $R^9$ to $R^{14}$ are methyl groups).

Representative examples of the alkane derivatives represented by the general formula (IV) are shown below. 1,2-Di(methylcyclohexyl)-2-methylpropane having the following formula:

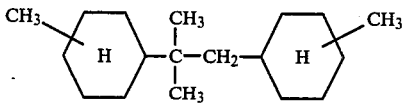

2,3-Di(methylcyclohexyl)-butane having the following formula:

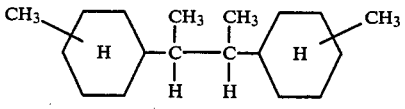

Representative examples of the alkane derivatives represented by the general formula (V) are shown below. 1,3-Dicyclohexyl-3-methylbutane having the following formula:

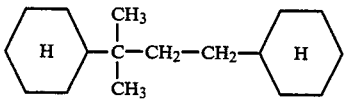

2,4-Dicyclohexylpentane having the formula:

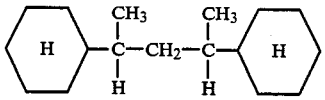

2,4-Dicyclohexyl-2-methylpentane having the formula:

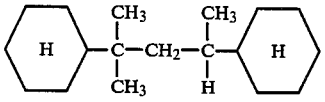

Type B2 Compounds are usually compounds represented by the general formula (VI):

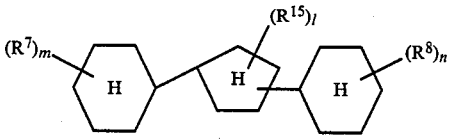

(VI)

(wherein $R^7$, $R^8$, m and n are the same as defined above, $R^{15}$ represents hydrogen or a methyl group, and l represents 1, 2 or 3).

A representative example of compounds represented by the general formula (VI) is shown below. 1,3-Dicyclohexyl-1-methylcyclopentane having the formula:

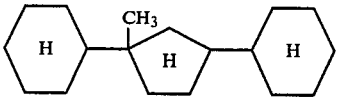

The fluid for traction drive of the present invention contains, as the principal ingredients thereof, Component (A) (Type A1 Compound, Type A2 Compound or Type A3 Compound) and Component (B) (Type B1 Compound or Type B2 Compound) and has a kinematic viscosity of at least 3 centistokes (cSt) at 100° C.

Component (A) has a high traction coefficient at high temperatures, but has a relatively high viscosity. Because of this relatively high viscosity, the stirring loss is large and furthermore Component (A) is not satisfactory in respect of the flowability at low temperatures. On the other hand, Component (B) has an advantage of having a low viscosity, but has problems that the traction coefficient seriously drops at high temperatures and furthermore the viscosity excessively drops, thereby causing discontinuity in the oil films. If, however, Components (A) and (B) are mixed in such a manner that the kinematic viscosity at 100° C. is at least 3 cSt as in the fluid for traction drive of the present invention, there can be obtained a fluid for traction drive which has a relatively low viscosity, exhibits a high traction coefficient over a wide temperature range from high temperature to low temperature, is satisfactory in the flowability at low temperatures and is freed of problems such as discontinuity of oil films at high temperatures.

The fluid for traction drive of the present invention is based on new findings that the traction coefficient can be greatly improved by mixing Compnents (A) and (B); that is, there can be obtained a synergistic effect of Components (A) and (B).

It is generally known that the traction efficient has the following additivity rule (ASLE Trans, 13, 105–116 (1969)).

$$f = \sum_i Cifi$$

where:

Ci=mixing ratio of Component i, fi=traction coefficient of Component i, f=traction coefficient of the resulting mixture.

It is also disclosed in SAE 710837 (1971) that the synergistic effect can be obtained to a slight extent (about 2–3%). It has been known, however, that if Components (A) and (B) are mixed, the traction coefficient of the resulting mixture is greater than that of each component and furthermore it is at least 10% greater than the weighted average of the values of the components.

In the present invention, the mixing ratio of Components (A) and (B) is not critical. It suffices that Components (A) and (B) are mixed in such a ratio that the kinematic viscosity at 100° C. is at least 3.0 cSt and preferably 3.6 to 10.0 cSt. More specifically, Component (B) is usually added in an amount of 10 to 900 parts by weight, preferably 50 to 600 parts by weight per 100 parts by weight of Component (A), although the mixing ratio cannot be determined unconditionally because it varies depending on the type of each component and so forth. If the fluid for traction drive has a kinematic viscosity at 100° C. of less than 3 cSt, the rolling-element fatigue life of a traction drive device cannot be maintained at more than the rated value and long time driving becomes impossible, even though the fluid for traction drive contains, as the principal ingredients thereof, Components (A) and (B).

The rolling-element fatigue life of a rolling surface is greatly dependent on a relation between the roughness of the rolling contact surfaces and the thickness of an oil film formed between two rolling contact surfaces; this relation is well known as an oil film parameter $\Lambda$. In connection with the relation between the oil film parameter $\Lambda$ and surface fatigue, it is said that if $0.9<\Lambda$, the life can be maintained at more than the predetermined value (Machine Design, volume 7, page 102 (1974)).

According to the results of a calculation carried out by applying the above described facts to an actual bearing as an example of the rolling contact surfaces assuming a working temperature of 100° C., a rolling contact fatigue life of at least the rated value or design value can be obtained when the fluid for traction drive has a viscosity of at least 3.0 cSt or, preferably, at least 3.6 cSt at the temperature. In other words, the fluid should be formulated in such a weight proportion of the components that the fluid may have a viscosity of at least 3.0 cSt or, preferably, at least 3.6 cSt at 100° C. It is also desirable for a fluid used in automobiles that the pour point thereof is −30° C. or lower in order to ensure smooth starting at low temperatures.

The fluid for traction drive of the present invention, which is, as described above, contains as the principal ingredients thereof, Components (A) and (B), may further contain various additives if necessary.

The fluid for traction drive of the present invention exhibits a high and stable traction coefficient over a wide temperature range from low temperature to high temperature and is excellent in various required properties. Therefore the fluid for traction drive of the present invention can be widely used in a wide variety of machines including continuously variable transmissions for automobiles and industrial machines, hydraulic machines and the like.

In the following, the fluid for traction drive of the invention is described in more detail by way of examples preceded by the description of the synthetic preparation of the compounds used as the components (A) and (B).

In the following Examples and Comparative Examples, the traction coefficient of the fluid was determined according to the procedure described below using a two roller machine. Each of the rollers had a diameter of 52 mm and a thickness of 6 mm and one of them for driving had a flat form without crowning while the other driven by the driving roller had a barrel-shaped form with a crown radius of 10 mm. One of the rollers was rotated at a constant velocity of 1500 rpm while the other was continuously rotated at a velocity of 1500 to 1750 rpm under a contacting pressure of 7 kg by means of a spring to determine the tangential force, i.e. traction force, generated between the rollers from which the traction coefficient was calculated. The rollers were made of a steel for rolling bearing SUJ-2 and the surface was polished as smooth as a mirror. The maximum Hertzian contact pressure thereof was 112 kgf/mm$^2$.

The determination of the relation between the traction coefficient and the oil temperature was performed by controlling the oil temperature in the range from 30° C. to 120° C. with the oil reservoir heated with a heater and the results were shown in a graph by plotting the relation between the traction coefficient at a slip ratio of 5% and the oil temperature.

The determination of the relation between the traction coefficient and the mixing ratio of the components (A) and (B) was performed by keeping the fluid at a constant temperature.

PREPARATION EXAMPLE 1

Preparation of Component (A)

A mixture of 3,100 grams (g) of anhydrous phenylcyclohexane, 40 g of metallic sodium and 11 g of isopropyl alcohol was placed in a 5-liter glass flask and heated to 130° C., and 650 g of styrene was dropped over 3 hours while vigorously stirring and subsequently the resulting mixture was stirred for 1 hour to complete the reaction. Stirring was stopped and the reaction mixture was allowed to stand and cool. Then an oil layer was separated and 200 g of ethanol was added. The resulting mixture was washed three times with each of 2 liters (l) of a 5N aqueous solution of hydrochloric acid and 2 l of saturated aqueous solution of sodium chloride, and dried over anhydrous sodium sulfate. The unreacted phenylcyclohexane was distilled away by the use of a rotary evaporater, and the residue was distilled under reduced pressure to yield 850 g of a fraction having a boiling point of 160°–170° C. at 0.3 mmHg (this fraction is hereinafter referred to as "Fraction f-1") and 550 g of a fraction having a boiling point of 210°–220° C. at 0.3 mmHg (this fraction is hereinafter referred to as "Fraction f-2"). An analysis confirmed that the Fraction f-1 was a compound resulting from addition of one styrene molecule to phenylcyclohexane, i.e., 1-phenyl-1-(2-phenylethyl)cyclohexane, and the Fraction f-2 was a compound resulting from addition of two styrene molecules to phenylcyclohexane, i.e., 1-phenyl-1-(2,4-diphenylbutyl)cyclohexane.

The above Fraction f-1, i.e., alkylated compound (500 milliliters (ml)) was placed in a 1-liter autoclave and 50 g of a nickel catalyst for hydrogenation (Catalyst N-112 manufactured by Nikki Kagaku Co., Ltd.) was added, and the Fraction f-1 was hydrogenated at a hydrogen presure of 50 kilograms per square centimeter (kg/cm$^2$) and a reaction temperature of 200° C. After cooling, the reaction mixture was filtered to remove the catalyst. An NMR analysis showed that a degree of hydrogenation was not less than 99.9%. The filtrate was stripped to remove the light fraction and then analyzed. This analysis showed that the light fraction was 1-cyclohexyl-1-(2-cyclohexylethyl)cyclohexane.

The fraction f-2 was also hydrogenated in the same manner as above and stripped to obtain 1-cyclohexyl-1-(2,4-dicyclohexylbutyl)cyclohexane.

PREPARATION EXAMPLE 2

Preparation of Component (B)

A mixture of 1,564 g of toluene and 40 g of anhydrous aluminum chloride was placed in a 3-liter flask, and a mixture of 272 g of methallyl chloride and 92 g of toluene was gradually dropped over 5 hours to the above mixture with stirring at room temperature. Then the resulting mixture was stirred for 1 hour to complete the reaction. At the end of the period, 500 ml of water was added to decompose the aluminum chloride. An oil layer was isolated, washed three times with 1,000 ml of a 1N aqueous solution of sodium hydroxide and then three times with 1,000 ml of saturated aqueous solution of sodium chloride, and then dried over anhydrous sodium sulfate. The unreacted toluene was distilled away, and the residue was distilled under reduced pressure to obtain 500 g of a fraction having a boiling point range of 106°–113° C. (0.16 mmHg). The main component of the fraction was 2-methyl-1,2-di(p-tolyl)propane.

Subsequently, 500 g of the above obtained fraction was placed in a 1-liter autoclave and hydrogenated for 3 hours under conditions of hydrogen pressure of 50 kg/cm$^2$G and temperature of 200° C. by the use of 50 g of a nickel catalyst for hydrogenation (N-113 produced by Nikki Kagaku Co., Ltd.). After stripping of light fraction, the reaction product was analyzed. This analysis showed that a degree of hydrogenation was 99.9% or more and the principal ingredient was 2-methyl-1,2-di(4-methylcyclohexyl)propane.

EXAMPLE 1

Figure 1:
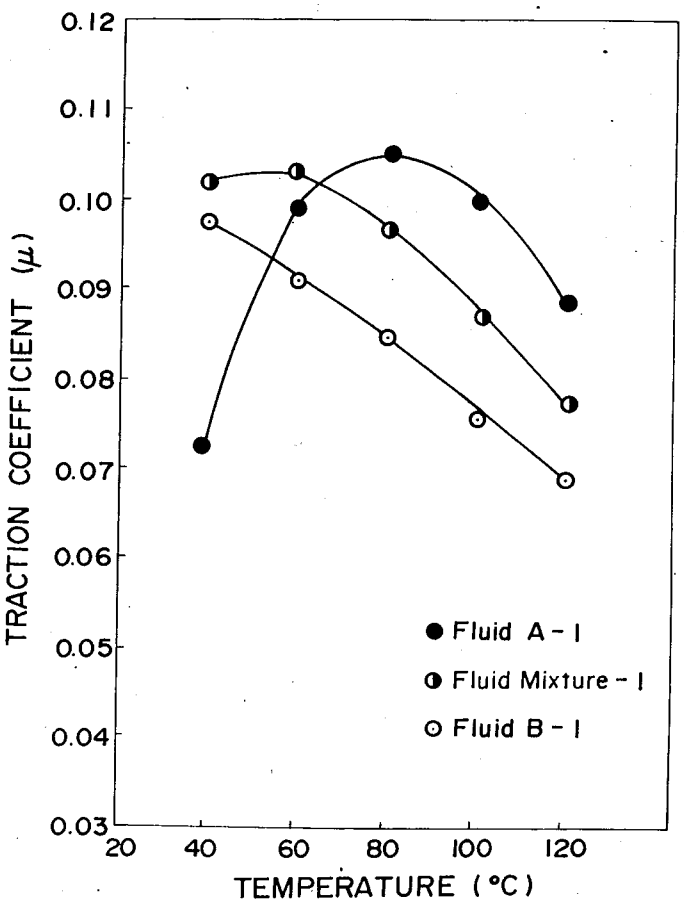
FIGS. 1, 3, 5, 7, 9 and 11 are graphs showing a relation between a traction coefficient of fluid and temperature in Examples and Comparative Examples.

A fluid containing 90% by weight of 1-cyclohexyl-1-(2-cyclohexylehtyl)cyclohexane and 10% by weight of 1-cyclohexyl-1-(2,4-dicyclohexylbutyl)cyclohexane (hereinafter referred to "Fluid A-1") as prepared in Preparation Example 1 and 2-methyl-1,2-di(4-methylcyclohexyl)propane (hereinafter referred to as "Fluid B-1) as prepared in Preparation Example 2 were mixed in such a manner that the weight ratio of Fluid A-1 to Fluid B-1 was 2:3 to prepare a fluid (hereinafter referred to as "Mixed Fluid-1"). Properties of Mixed Fluid-1 are shown in Table 1. A relation between the traction coefficient of Mixed Fluid-1 and temperature is shown in FIG. 1. In addition, changes at 60° C. in the traction coefficient of mixed fluids as obtained by changing the ratio of Fluid A-1 and Fluid B-1 are shown in FIG. 2.

COMPARATIVE EXAMPLE 1

Properties of Fluid A-1 as prepared in Preparation Example 1 are shown in Table 1, and a relation between the traction coefficient of Fluid A-1 and temperature is shown in FIG. 1.

COMPARATIVE EXAMPLE 2

Properties of Fluid B-1 as prepared in Preparation Example 2 are shown in Table 1, and a relation between the traction coefficient of Fluid B-1 and temperature is shown in FIG. 1.

TABLE 1

| | Fluid | Kinematic Viscosity (cSt) at 40° C. | Kinematic Viscosity (cSt) at 100° C. | Viscosity Index | Pour Point (°C.) |
|---|---|---|---|---|---|
| Example 1 | Mixed Fluid-1 | 33.27 | 4.035 | −129 | −30.0 |
| Comparative Example 1 | Fluid A-1 | 249.1 | 9.109 | −229 | −7.5 |
| Comparative Example 2 | Fluid B-1 | 13.09 | 2.640 | −22 | less than −35 |

PREPARATION EXAMPLE 3

Preparation of Component (A)

The procedure of Preparation Example 1 was repeated with the exception that 2,300 g of anhydrous cumene was used in place of 3,100 g of anhydrous phenylcyclohexane, to thereby obtain 1,100 g of a fraction having a boiling point of 115°–125° C./0.13 mmHg (hereinafter referred to as "Fraction g-1") and 450 g of a fraction having a boiling point of 155°–165° C./0.13 mmHg (hereinafter referred to as "Fraction g-2"). Each fraction was analyzed. This analysis showed that Fraction g-1 was a compound resulting from addition of one styrene molecule to cumene, i.e., 1,3-diphenyl-3-methylbutane, and Fraction g-2 was a compound resulting from addition of two styrene molecules to cumene, i.e., 1,3,5-triphenyl-5-methylhexane.

Fraction g-1 was hydrogenated and was subjected to post-treatment in the same manner as in Preparation Example 1 to obtain 1,3-dicyclohexyl-3-methylbutane.

Fraction g-2 was also hydrogenated in the same manner as above and stripped to obtain 1,3,5-tricyclohexyl-5-methylhexane.

EXAMPLE 2

Figure 3:
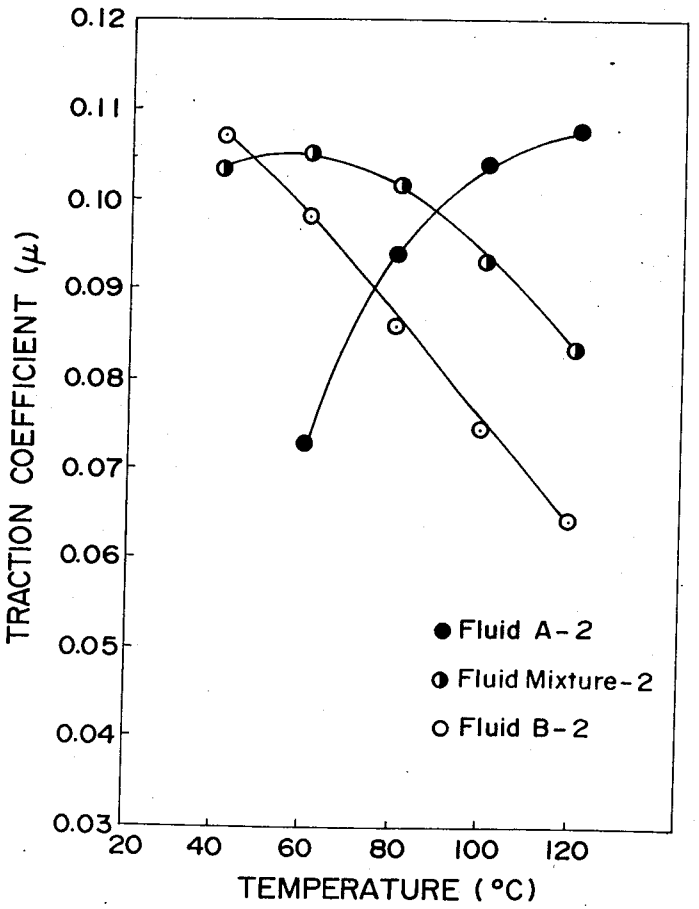
Figure 4:
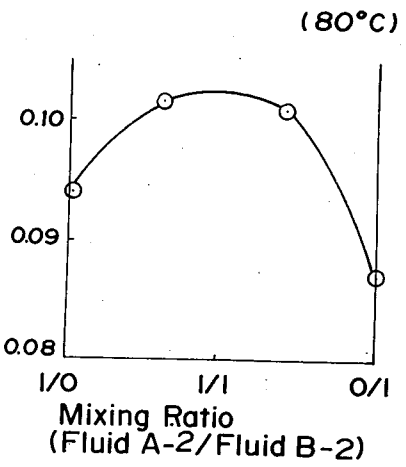

A fluid composed mainly of 1,3,5-tricyclohexyl-5-methylhexane as obtained in Preparation Example 3 (hereinafter referred to as "Fluid A-2") and a fluid composed mainly of 1,3-dicyclohexyl-3-methylbutane as obtained in Preparation Example 3 (hereinafter referred to as "Fluid B-2") were mixed in such a manner that the weight ratio of Fluid A-2 to Fluid B-2 was 3:7 to prepare a fluid (hereinafter referred to as "Mixed Fluid-2"). Properties of Mixed Fluid-2 are shown in Table 2. A relation between the traction coefficient of Mixed Fluid-2 and temperature is shown in FIG. 3. In addition, changes in the traction coefficient at 80° C. of mixed fluids as obtained by changing the ratio of Fluid A-2 to Fluid B-2 are shown in FIG. 4.

COMPARATIVE EXAMPLE 3

Properties of Fluid A-2 as obtained in Preparation Example 3 are shown in Table 2, and a relation between the traction coefficient of Fluid A-2 and temperature is shown in FIG. 3.

COMPARATIVE EXAMPLE 4

Properties of Fluid B-2 as obtained in Preparation Example 3 are shown in Table 2, and a relation between the traction coefficient of Fluid B-2 and temperature is shown in FIG. 3.

TABLE 2

| | Fluid | Kinematic viscosity (cSt) at 40° C. | Kinematic viscosity (cSt) at 100° C. | Viscosity Index | Pour Point (°C.) |
|---|---|---|---|---|---|
| Example 2 | Mixed Fluid-2 | 44.65 | 4.973 | −42 | −32.5 |
| Comparative Example 3 | Fluid A-2 | 2166 | 21.10 | −552 | +2.5 |
| Comparative Example 4 | Fluid B-2 | 16.47 | 3.208 | 23 | less than −35 |

PREPARATION EXAMPLE 4

Preparation of Component (A)

A mixture of 2,700 g of ethylbenzene, 58 g of metallic sodium and 17 g of isopropyl alcohol was placed in a 5-liter glass flask and heated to 120° C., and then a mixture of 1,100 g of α-methylstyrene and 300 g of ethylbenzene was gradually added over 5 hours with stirring. The resulting mixture was stirred for 1 hour to complete the reaction.

After completion of the reaction, the reaction mixture was cooled, and an oil layer was isolated. To this oil layer was added 200 g of methyl alcohol, and the resulting mixture was washed three times with 2,000 ml of a 5N aqueous hydrochloric acid solution and then three times with 2,000 ml of saturated aqueous solution of sodium chloride. Then the mixture was dried over anhydrous sodium sulfate, and the unreacted ethylbenzene was distilled away by the use of a rotary evaporator. The residue was distilled under reduced pressure to obtain 1,500 g of a fraction having a boiling point range of 104°–110° C. at 0.06 mmHg. An analysis showed that the fraction was 2,4-diphenyl-pentane.

Then, 500 ml of the above fraction was place in a 1-liter autoclave and hydrogenated under conditions of reaction temperature 200° C. and hydrogen pressure of 50 kg/cm$^2$G by the use of a nickel catalyst for hydrogenation (N-113 catalyst produced by Nikki Kagaku Co., Ltd.). After completion of the reaction, the reaction mixture was filtered to remove the catalyst. The filtrate was to remove the light fraction and then analyzed. This analysis showed that a degree of hydrogenation was not less than 99.9% and the hydrogenation product was 2,4-dicyclohexylpentane.

EXAMPLE 3

Figure 6:
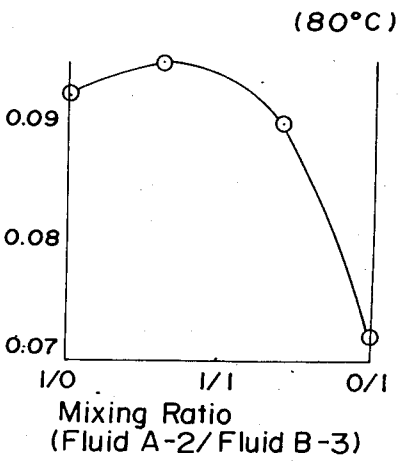
Figure 5:
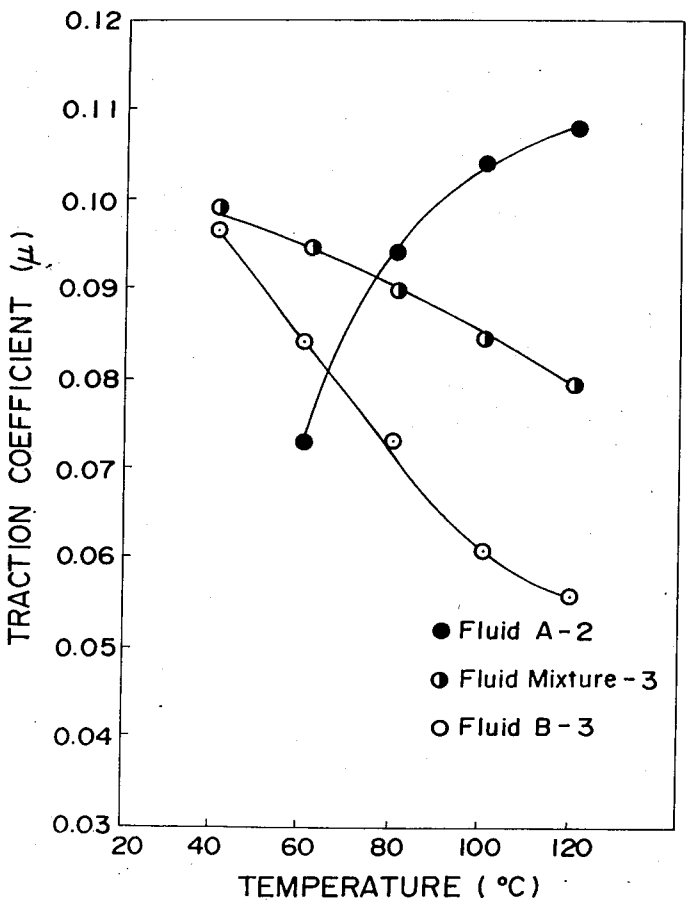

Fluid A-2 as obtained in Preparation Example 3 and a fluid composed mainly of 2,4-dicyclohexylpentane as obtained in Preparation Example 4 (hereinafter referred to as "Fluid B-3") were mixed in such a manner that the weight ratio of Fluid A-2 to Fluid B-3 was 3:7 to prepare a fluid (hereinafter referred to as "Mixed Fluid-3"). Properties of Mixed Fluid-3 are shown in Table 3. A relation between the traction coefficient of Mixed Fluid-3 and temperature is shown in FIG. 5. Changes in the traction coefficient of mixed fluids as obtained by changing the ratio of Fluid A-2 to Fluid B-3 are shown in FIG. 6.

COMPARATIVE EXAMPLE 5

Properties of Fluid B-3 as obtained in Preparation Example 4 are shown in Table 3, and a relation between the traction coefficient of Fluid B-3 and temperature is shown in FIG. 5. For reference, the properties and so forth of Fluid A-2 are also shown in Table 3 and FIG. 5.

TABLE 3

| | Fluid | Kinematic viscosity (cSt) at 40° C. | Kinematic viscosity (cSt) at 100° C. | Viscosity Index | Pour Point (°C.) |
|---|---|---|---|---|---|
| Example 3 | Mixed Fluid-3 | 31.82 | 4.307 | −32 | −35.0 |
| Comparative Example 3 | Fluid A-2 | 2166 | 21.10 | −552 | +2.5 |
| Comparative Example 5 | Fluid B-3 | 11.82 | 2.722 | 48 | less than −35 |

PREPARATION EXAMPLE 5

Preparation of Component (B)

A mixture of 1,000 g of α-methylstyrene, 50 g of acid clay and 50 g of ethylene glycol was placed in a 3-liter flask and reacted at 140° C. for 2 hours with stirring. The catalyst was removed from the reaction mixture by filtration. The unreacted α-methylstyrene and ethylene glycol were distilled away to obtain 900 g of a fraction having a boiling point of 125°–130° C./0.2 mmHg. NMR and gas chromatographic analyses showed that the fraction was a mixture of 95% of a linear dimer of α-methylstyrene and 5% of a cyclinc dimer of α-methylstyrene.

The above fraction was hydrogenated and was subjected to post-treatment in the same manner as in Preparation Example 2 to obtain a fluid for traction drive composed mainly of 2,4-dicyclohexyl-2-methylpentane.

EXAMPLE 4

Figure 8:
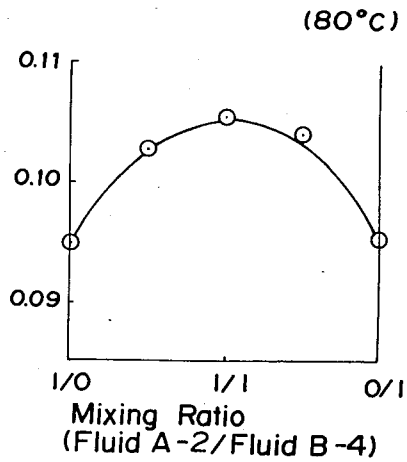
Figure 7:
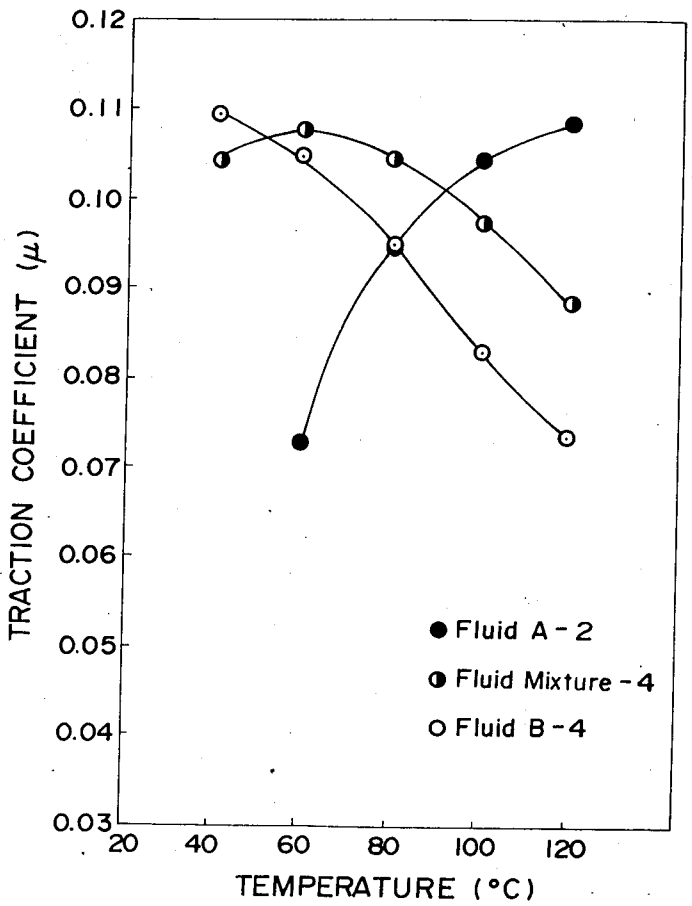

Fluid A-2 as obtained in Preparation Example 3 and a fluid composed mainly of 2,4-dicyclohexyl-2-methylpentane as obtained in Preparation Example 5 (hereinafter referred to as "Fluid B-4") were mixed in such a manner that the weight ratio of Fluid A-2 to Fluid B-4 was 1:3 to prepare a fluid (hereinafter referred to as "Mixed Fluid-4"). Properties of Mixed Fluid-4 are shown in Table 4. A relation between the traction coefficient of Mixed Fluid-4 and temperature is shown in FIG. 7. In addition, changes in the traction coefficient of mixed fluids prepared by changing the ratio of Fluid A-2 to Fluid B-4 are shown in FIG. 8.

COMPARATIVE EXAMPLE 6

Properties of Fluid B-4 as obtained in Preparation Example 5 are shown in Table 4, and a relation between the traction coefficient of Fluid B-4 and temperature is shown in FIG. 7. For reference, the properties and so forth of Fluid A-2 are also shown in Table 4 and FIG. 7.

TABLE 4

| | Fluid | Kinematic viscosity (cSt) at 40° C. | Kinematic viscosity (cSt) at 100° C. | Viscosity Index | Pour Point (°C.) |
|---|---|---|---|---|---|
| Example 4 | Mixed Fluid-4 | 45.91 | 5.026 | −44 | −32.5 |
| Comparative Example 3 | Fluid A-2 | 2166 | 21.10 | −552 | +2.5 |
| Comparative Example 6 | Fluid B-4 | 20.27 | 3.580 | 13 | less than −35 |

EXAMPLE 5

Figure 10:
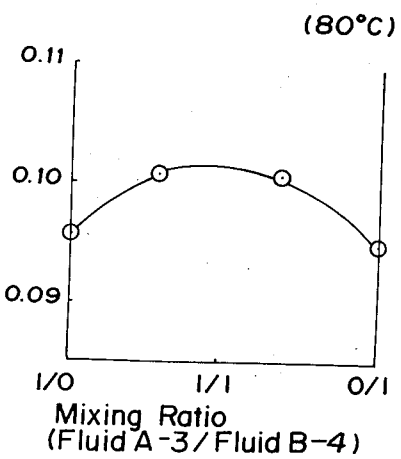
Figure 9:
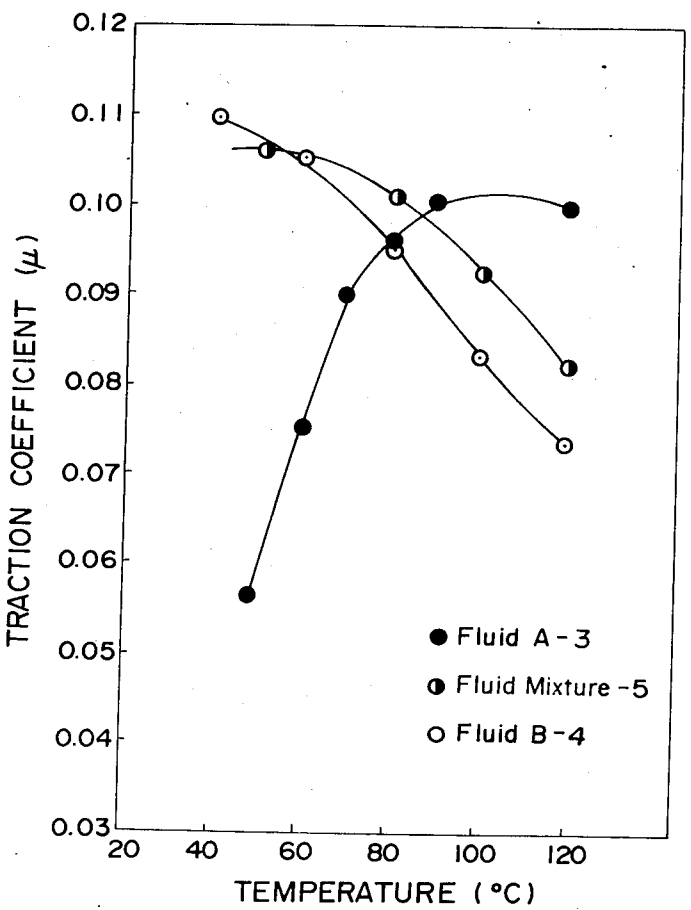

A fluid containing 60% by weight of 1-cyclohexyl-1-(2-cyclohexylethyl)cyclohexane, 30% by weight of 1-cyclohexyl-1-(2,4-dicyclohexylbutyl)cyclohexane, and 10% by weight of 1-cyclohexyl-1-(2,4,6-tricyclohexylhexyl)cyclohexane as obtained in Preparation Example 1 (hereinafter referred to as "Fluid A-3") and Fluid B-4 as obtained in Preparation Example 5 were mixed in such a manner that the weight ratio Fluid A-3 to Fluid B-4 was 3:7 to prepare a fluid (hereinafter referred to as "Mixed Fluid-5"). Properties of Mixed Fluid-5 are shown in Table 5. A relation between the traction coefficient of Mixed Fluid-5 and temperature is shown in FIG. 9. In addition, changes in the traction coefficient at 80° C. of mixed fluids as obtained by changing the ratio of Fluid A-3 to Fluid B-4 are shown in FIG. 10.

COMPARATIVE EXAMPLE 7

Properties of Fluid A-3 as obtained in Preparation Example 1 are shown in Table 5, and a relation between the traction coefficient of Fluid A-3 and temperature is shown in FIG. 9. For reference, the properties and so forth of Fluid B-4 are also shown in Table 5 and FIG. 9.

TABLE 5

| | Fluid | Kinematic Viscosity (cSt) at 40° C. | at 100° C. | Viscosity Index | Pour Point (°C.) |
|---|---|---|---|---|---|
| Example 5 | Mixed Fluid-5 | 44.62 | 5.134 | −16 | −30.0 |
| Comparative Example 7 | Fluid A-3 | 751.5 | 13.61 | −415 | −5.0 |
| Comparative Example 4 | Fluid B-4 | 20.27 | 3.580 | 13 | less than −35 |

PREPARATION EXAMPLE 6

Preparation of Component (B)

A 1-liter four-necked glass flask equipped with a stirrer, a dropping funnel, a reflux condenser provided with a drier tube of a calcium chloride and a bufurcated tube provided with a thermometer and a gas introduction tube was charged with 200 ml of decahydronaphthalene, 9.2 g (0.40 mol) of metallic sodium and 11.2 g (0.20 mol) of potassium hydroxide. Then argon gas was introduced in the flask through the gas introduction tube at a rate of 100 ml per minute for 10 minutes, and then the mixture was stirred while introducing argon gas at a decreased rate of 10 ml per minute. Thereafter, the contents of the flask was heated to 135° C. on an oil bath, and 473 g (4.0 mol) of α-methylstyrene was dropped over 1 hour. After completion of the addition, the mixture was further stirred for 30 minutes while heating. The mixture was cooled to room temperature, and 100 ml of methanol was dropped with stirring to decompose the unreacted metallic sodium. Introduction of argon gas was stopped, and the reaction mixture was washed three time each with 200 ml of water. A oil layer was dried over anhydrous sodium sulfate and distilled under reduced pressure (139°–141° C./0.2 mmHg) to obtain a fraction composed mainly of 250.7 g (2.12 mol) of 1-methyl-1,3-diphenylcyclopentane.

Then 200 g (0.85 mol) of the above 1-methyl-1,3-diphenylcyclopentane and 10 g of nickel catalyst (N-113 produced by Nikki Kagaku Co., Ltd.) were placed in a magnetic agitation type 1-liter stainless steel autoclave, and the 1-methyl-1,3-diphenylcyclopentane was hydrogenated for 2 hours under conditions of hydrogen pressure of 20 atmospheric pressure and temperature of 150° C. After completion of the reaction, the catalyst was removed by filtration. The resulting filtrate and a liquid which attached to the catalyst and was recovered with xylene were combined together, and the xylene was distilled away by the use of rotary evaporator to obtain a fraction composed mainly of 206 g of 1,3-dicyclohexyl-1-methylcyclopentane.

EXAMPLE 6

Figure 12:
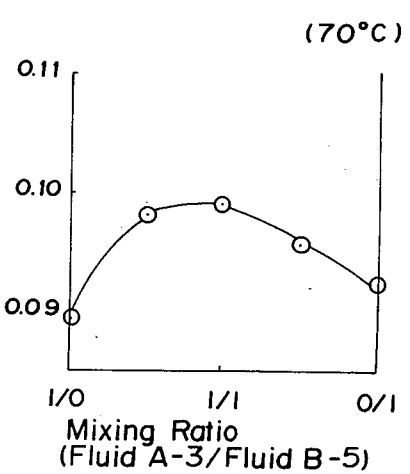
Figure 11:
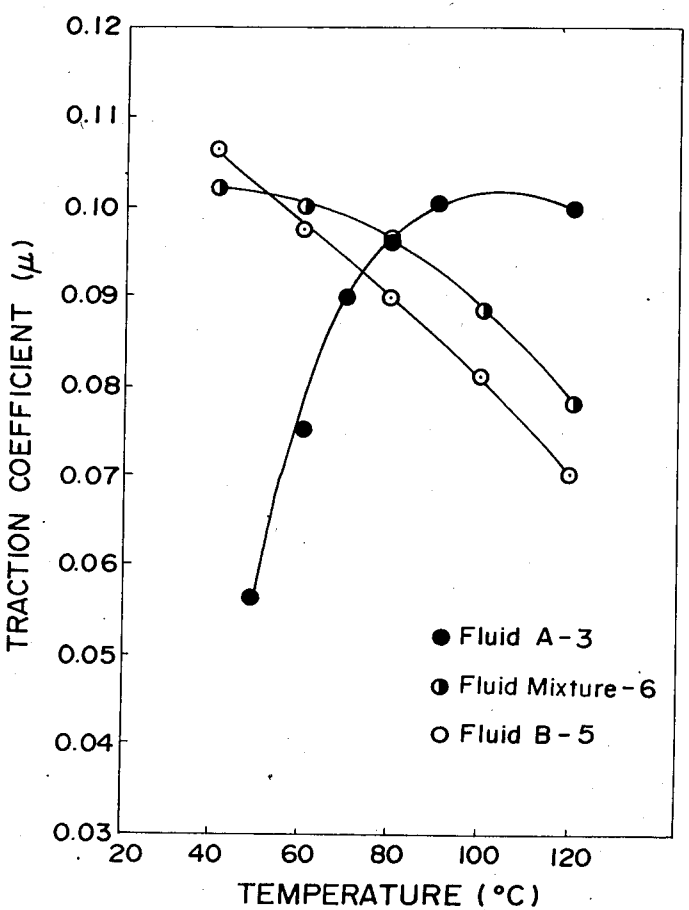

Fluid A-3 as obtained in Preparation Example 1 and a fluid composed mainly of 1,3-dicyclohexyl-1-methylcyclopentane (hereinafter referred to as "Fluid B-5") were mixed in such a manner that the weight ratio of Fluid A-3 to Fluid B-5 was 1:3 to prepare a fluid (hereinafter referred to as "Mixed Fluid-6"). Properties of Mixed Fluid-6 are shown in Table 6. A relation between the traction coefficient of Mixed Fluid-6 and temperature is shown in FIG. 11. In addition, changes in the traction coefficient at 70° C. of mixed fluids as obtained by changing the ratio of Fluid A-3 to Fluid B-5 are shown in FIG. 12.

COMPARATIVE EXAMPLE 8

Properties of Fluid B-5 as obtained in Preparation Example 6 are shown in Table 6, and a relation between the traction coefficient of Fluid B-5 and temperature is shown in FIG. 11. For reference, the properties and so forth of Fluid A-3 are also shown in Table 6 and FIG. 11.

TABLE 6

| | Fluid | Kinematic Viscosity (cSt) at 40° C. | at 100° C. | Viscosity Index | Pour Point (°C.) |
|---|---|---|---|---|---|
| Example 6 | Mixed Fluid-6 | 39.13 | 4.879 | −9 | −32.5 |
| Comparative Example 7 | Fluid A-3 | 751.5 | 13.61 | −415 | −5.0 |
| Comparative Example 8 | Fluid B-5 | 21.15 | 3.798 | 38 | less than −35 |

What is claimed is:

1. A fluid for traction drive containing:

(A) an alkane derivative having at least three cyclohexane rings in a molecule; and (B) an alkane derivative having a main chain of two or three carbon atoms, to which at least two methyl groups are bonded, and having two cyclohexane rings in a molecule each bonded to one of the terminal carbon atoms of the alkane, or a cyclopentane derivative having two cyclohexane rings in a molecule, and which has a kinematic viscosity of at least 3 centistokes at 100° C.

2. The fluid as claimed in claim 1, wherein the amount of the component (B) compounded is 10 to 900 parts by weight per 100 parts by weight of the component (A).

3. The fluid as claimed in claim 1, wherein the alkane derivative as the component (A) having at least three cyclohexane rings is a compound represented by the general formula:

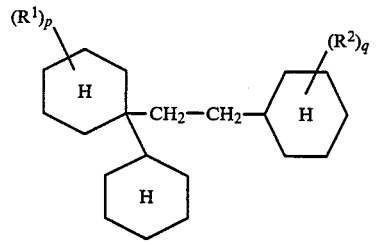

(wherein $R^1$ and $R^2$ each represent a hydrogen atom or a methyl group, and p and q each represent 1, 2 or 3).

4. The fluid as claimed in claim 1, wherein the alkane derivative as the component (A) having at least three cyclohexane rings is a compound represented by the general formula:

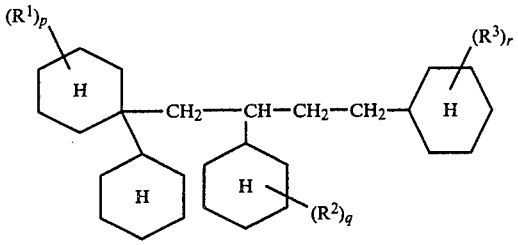

(wherein $R^1$, $R^2$ and $R^3$ each represent a hydrogen atom or a methyl group, and p, q and r each represent 1, 2 or 3).

5. The fluid as claimed in claim 1, wherein the alkane derivative as the component (A) having at least three cyclohexane rings is a compound represented by the general formula:

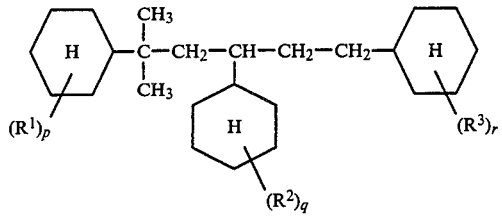

(wherein $R^1$, $R^2$ and $R^3$ each represent a hydrogen atom or a methyl group, and p, q and r each represent 1, 2 or 3).

6. The fluid as claimed in claim 1, wherein the alkane derivative as the component (B) having two carbon atoms in a molecule is a compound represented by the general formula:

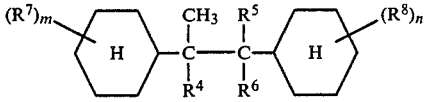

(wherein $R^4$ to $R^8$ each represent a hydrogen atom or a methyl group, and m and n each represent 1, 2 or 3, provided that at least one of $R^4$ to $R^6$ represents a methyl group).

7. The fluid as claimed in claim 1, wherein the alkane derivative as the component (B) having three carbon atoms in a molecule is a compounded represented by the general formula:

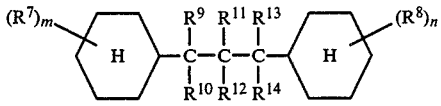

(wherein $R^7$ to $R^{14}$ each represent a hydrogen atom or a methyl group, and m and n each represent 1, 2 or 3, provided that at least two of $R^9$ to $R^{14}$ represent a methyl group).

8. The fluid as claimed in claim 1, wherein the cyclopentane derivative as the component (B) having two cyclohexane rings is a compound represented by the general formula:

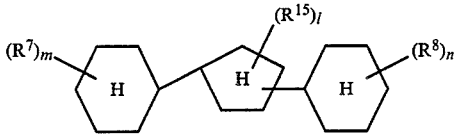

(wherein $R^7$, $R^8$ and $R^{15}$ each represent a hydrogen atom or a methyl group, and l, m and n each represent 1, 2 or 3).

* * * * *